United States Patent [19]

Frank

[11] 3,991,890

[45] Nov. 16, 1976

[54] TRACTOR MOUNTED IMPLEMENT DEVICE

[75] Inventor: Eldon M. Frank, Lake View, Iowa

[73] Assignee: F & W Company, Inc., Lake View, Iowa

[22] Filed: Feb. 3, 1975

[21] Appl. No.: 546,434

Related U.S. Application Data

[63] Continuation-in-part of Ser. No. 260,465, June 7, 1972, Pat. No. 3,863,786.

[52] U.S. Cl. ..... 214/131 A; 172/275; 214/152

[51] Int. Cl.[2] ..... E02F 3/72

[58] Field of Search..... 214/131 A, 145, 152; 172/272, 275

[56] References Cited

UNITED STATES PATENTS

| | | | |
|---|---|---|---|
| 3,043,375 | 7/1962 | Astrom | 214/131 A |
| 3,324,954 | 6/1967 | Westendorf | 214/131 A |

FOREIGN PATENTS OR APPLICATIONS

| | | | |
|---|---|---|---|
| 833,368 | 2/1970 | Canada | 214/131 A |
| 1,248,551 | 8/1967 | Germany | 214/131 A |
| 1,924,269 | 11/1970 | Germany | 214/131 A |

OTHER PUBLICATIONS

"Triggs Farming Tools Catalog," pp. 7–9, Printed Nov. 1, 1967.

*Primary Examiner*—Robert J. Spar
*Assistant Examiner*—Ross Weaver
*Attorney, Agent, or Firm*—Zarley, McKee, Thomte & Voorhees

[57] ABSTRACT

A ground-working tool is mounted on the forward end of a boom pivotally connected to upstanding standards on a U-shaped frame having a transversely extending member at the forward end from which a support stand depends for engagement with the ground to support the implement independently of the tractor in cooperation with the ground-working tool. Hydraulic cylinders extend between the U-shaped frame and the boom to pivot the boom relative to the frame. A tractor includes oppositely disposed rearwardly mounted support brackets for supportingly engaging the standards while the forward end of the tractor includes a step bracket having vertical and horizontal portions over which an L-shaped stop plate is positioned. In mounting the implement on the tractor the tractor is driven into the U-shaped frame until the vertical portion of the front tractor bracket engages the transversely extending portion of the U-shaped frame whereupon the power cylinders are connected to the hydraulic system of the tractor and operated to pivot the boom towards the U-shaped frame member about an axis through the vertical portion of the step bracket causing the standards to pivot down into engagement with the side brackets on the tractor. The pivoting continues until the transversely extending frame portion is above the horizontal portion of the step bracket. Next the tractor is driven forwardly relative to the implement allowing the transversely extending portion to move onto the horizontal portion of the step where it is now limited against up or down vertical movement and rearward movement by this stop plate and the step. A lock opening is provided on each of the side brackets to receive a wedge-shaped foot on the bottom of the standards whereupon a spring-loaded cam actuated pin may engage the foot. The foot moves into the lock opening upon the tractor being driven forwardly and as the transversely extending frame member moves onto the step bracket.

13 Claims, 6 Drawing Figures

TRACTOR MOUNTED IMPLEMENT DEVICE

BACKGROUND OF THE INVENTION

This application is a continuation-in-part application of my co-pending Implement Device And Method of Mounting Same On Tractor, application Ser. No. 260,465, filed June 7, 1972, now U.S. Pat."No. 3,863,786.

The previous disclosure involves utilizing the power cylinders for mounting the implement on the tractor without driving the tractor forward. The mounting structure and procedure of this invention utilizes the power cylinders for pivoting the implement to a horizontal position followed by the tractor being moved forwardly relative to the implement to lock the implement in place on the tractor. This structure and procedure are particularly well suited for certain types of tractors including utility tractors which do not have side frame members extending from front to rear for mounting front support side brackets.

SUMMARY OF THE INVENTION

The present invention contemplates the implement being able to stand freely independently of the tractor supported by the ground-working tool and a support stand carried on the forward end of the U-shaped frame member. The tractor includes a front step bracket having a downwardly extending vertical portion and a rearwardly extending horizontal portion over which a L-shaped stop plate is positioned. The lower ends of the support standards of the implement are supported on side support brackets which include launching structure actuated simultaneously with the locking of the U-shaped frame to the front step bracket as the tractor is driven forwardly relative to the implement after the implement has been pivoted about an axis through the vertical portion of the step by the hydraulic lift cylinders causing the boom and the U-shaped frame to pivot towards each other while also causing the standards to pivot downwardly into engagement with the side support brackets. At this time the tractor may be driven forwardly a couple of inches to cause the transversely extending frame member of the U-shaped member to move onto the horizontal portion of the step under the stop plate while a rearwardly extending wedge-shaped foot on the standards moves into a complementary-shaped lock opening on the side brackets whereupon a lock pin is dropped into engagement with the foot through operation of an elliptical cam element on the pin.

DESCRIPTION OF THE DRAWINGS

In the drawings which illustrate an embodiment of the invention.

DESCRIPTION OF THE PREFERRED EMBODIMENT

Figure 1:
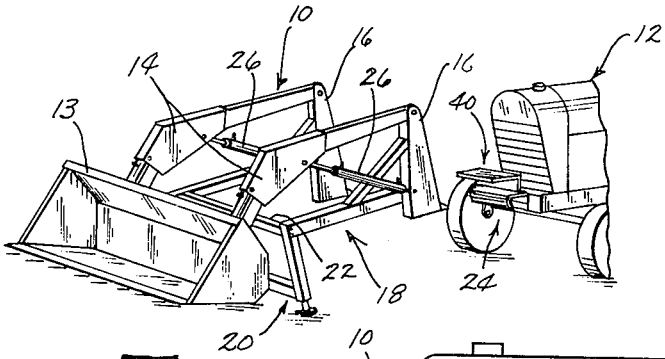
FIG. 1 is a perspective view of the implement shown detached from the tractor.

The implement of this invention is referred to generally in FIG. 1 by the reference numeral 10 and can be mounted on the tractor 12.

The implement 10 includes a scoop 13 mounted on a pair of boom arms 14 connected to upstanding standards 16 in turn connected to a U-shaped frame 18 having a pivotal stand 20 for supporting the implement in cooperation with the scoop 13 independently of the tractor 12. The U-shaped frame 18 includes a cross frame member 22 for engagement with a front-mounted step mounting bracket 24 on the front end of the tractor 12. A pair of hydraulic power cylinders 26 pivot the boom members 14 relative to the U-shaped frame 18. The lower ends of the standard 16 are supported by side brackets 30 on the tractor.

The tractor mounted front step bracket 24 includes a convex forwardly downwardly extending vertical portion 32 which merges into a rearwardly extending horizontal portion 34 and an upstanding leg 36 of a stop plate 40 is provided on the horizontal portion 34. The stop plate 40 includes a forwardly extending horizontal wall 42.

Figure 2:
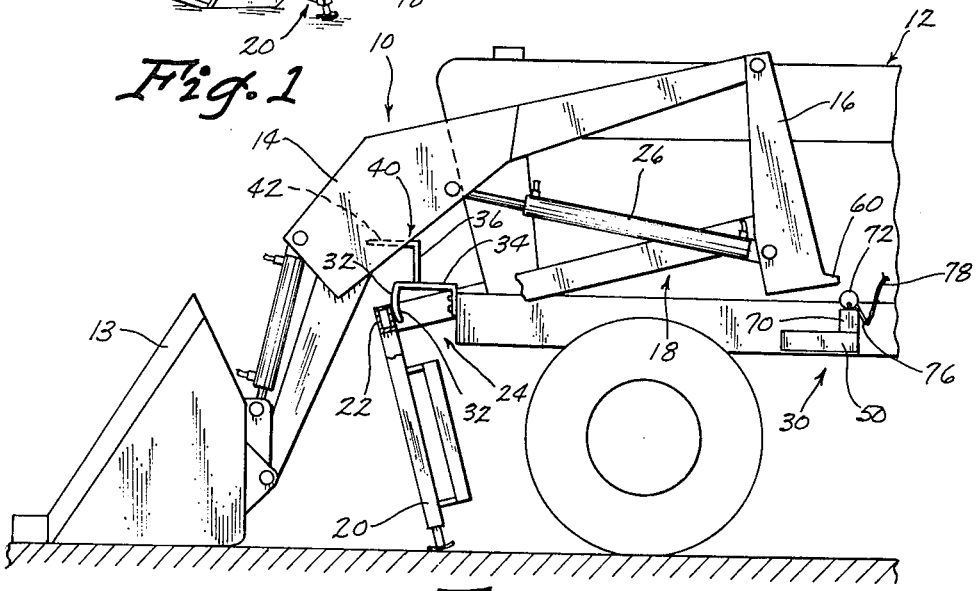
FIG. 2 is a side elevation enlarged view showing the tractor driven into the U-shaped frame with the front step mounting plate engaging the transversely extending frame member of the U-shaped frame.
Figure 3:
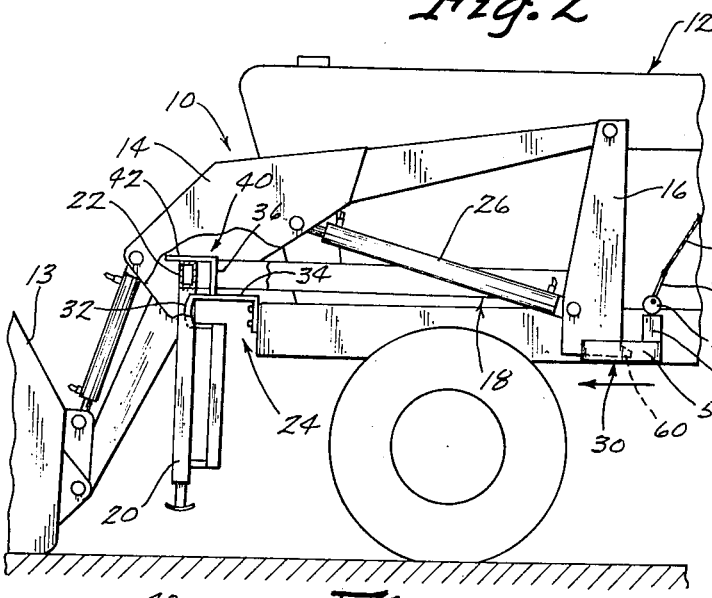
FIG. 3 is a view similar to FIG. 2 showing the implement pivoted to a horizontal position.
Figure 4:
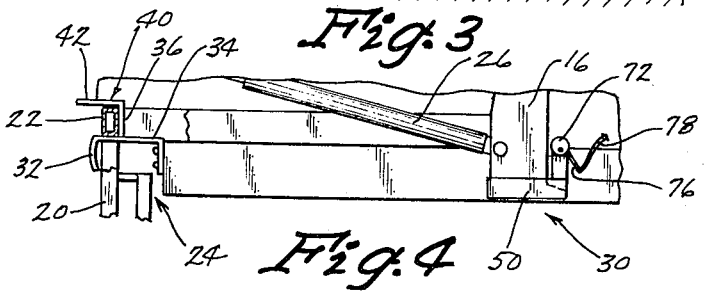
FIG. 4 is a reduced in scale view similar to FIG. 2 but showing the implement moved horizontally to the fully mounted position by the tractor having been driven forwardly relative to the implement.
Figure 5:
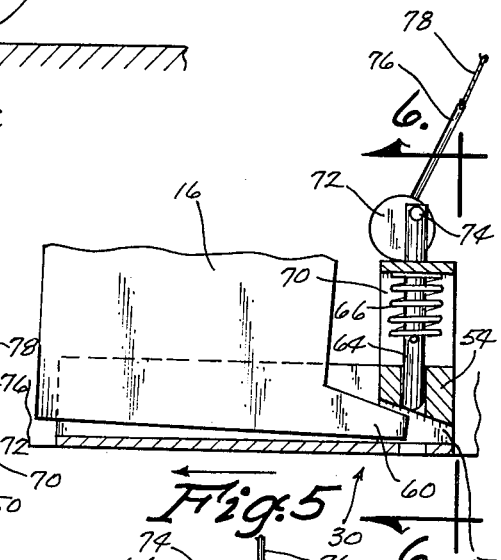
FIG. 5 is a fragmentary enlarged in scale side elevation view of the foot on the standard being moved into the lock opening on the side mounting bracket on the tractor.
Figure 6:
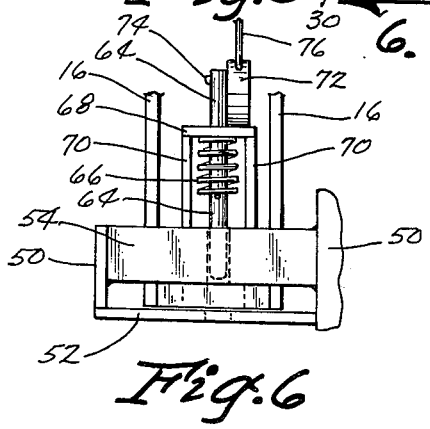
FIG. 6 is a cross-sectional view taken along line 6 — 6 in FIG. 5.

Each of the side mounted support brackets 30 includes side plates 50 on a bottom wall 52 and are interconnected by a cross element 54 cooperating with the bottom wall 52 to define a lock opening 56 which is wedge-shaped and complements a wedge-shaped foot 60 on the standard 16. A locking pin 64 is spring biased downwardly by a spring 66 engaging a top plate 68 mounted on a pair of legs 70. An eccentrically mounted cam 72 is pivotally connected to the pin 64 at 74 and engages the top plate 68 as it is pivoted by a lever 76 having a rope 78 attached thereto for actuation of the pin 54 from the tractor seat. Thus in operation it is seen that the implement independent of the tractor in FIG. 1, may be approached by the tractor driving into the U-shaped frame as seen in FIG. 2 until the downwardly extending vertical portion 32 of the step 24 engages the transversely extending frame member 22 of the U-shaped frame 18. Next the hydraulic cylinders are connected to the hydraulic system of the tractor such that the power cylinders 26 may be contracted causing the boom members 14 and the U-shaped frame 18 to pivot towards each other about an axis through the vertical portion 32 of the step bracket 24 thereby causing the standards 16 at the rear end of the implement to move downwardly into engagement with the side mounted brackets 30. This pivotal action is continued until the transversely extending member 22 is positioned above the horizontal portion 34 of the step 24 as seen in FIG. 3. Now the tractor is driven forwardly relative to the stationary implement held in place by the scoop 13 engaging the ground. The distance of travel is only a couple of inches such that the transversely extending frame member 22 moves along the horizontal portion 34 into engagement with the wall 36 which cooperates with the horizontal wall 42 of the stop plate 40 to limit vertical up and down and rearward movement of the implement.

At the same time the front of the implement is being locked onto the tractor through the step-mounting plate 24, the rear located standards 16 are being locked to the side mounted brackets 30 by the feet 60 moving into the wedge-shaped opening 56, as seen in FIG. 3, and the pin 64 being moved into engagement with an opening in the feet 60 as the lever 76 is operated to in turn operate the cam 72 which allows the pins 64 to move downwardly through the cross portion 54. Lever 76 may be operated by the rope 78 positioned at the operator's station on the tractor.

Removal of the implement from the tractor involves reversing the procedure. The support stand 20 is pivoted to the down position as it may be pivoted to a vertical upright position when the implement is mounted on the tractor. The pins 64 would be lifted by operation of the levers 76 connected to the cam 72 engaging the stationary plate 68. The scoop, of course, has been lowered to the ground and now the tractor is backed up to the position of FIG. 3 where the power cylinders 26 support the frame 18 with the transversely extending cross member 22 being above the horizontal step portion 34. The extension of the cylinders will cause the forward end of the U-shaped frame to pivot downwardly to the position of FIG. 2 thereby allowing the tractor to be totally backed out of the U-shaped frame leaving the implement supported on the ground-working tool and the stand 20.

I claim:

1. The method of mounting an implement on a tractor wherein the implement includes a ground-engaging tool carried on a boom pivotally connected to upright standards on a U-shaped frame having a support stand for supporting said implement in cooperation with said tool independent of said tractor, and said tractor including a step having vertical and horizontal portions on its front end and rearwardly positioned support brackets on opposite sides thereof, said method comprising the steps of, driving the tractor forwardly until a transversely extending portion on the U-shaped frame is position against the vertical portion of said step, operating the power means to pivot said boom and said U-shaped frame towards each other about an axis through the vertical portion of said step and until the upright standards engage said support brackets, operating said power means further and pivoting said transversely extending portion upwardly about an axis through said support brackets until said transversely extending portion is above the horizontal portion of said step, and moving the tractor forward relative to said implement thereby moving the horizontal portion of said step under the transversely extending portion.

2. The method of claim 1 wherein moving said tractor forwardly relative to the implement causes said standards to move into locking engagement with said support brackets.

3. In combination, an implement mountable on a tractor, comprising, an implement having a boom with a ground-engaging tool on the outer end and pivotally mounted to upright standards at its inner end carried on a U-shaped frame and power means interconnects said U-shaped frame and boom for relative pivotal movement therebetween, said U-shaped frame having a transversely extending member and a stand connected to said U-shaped frame for cooperation with said tool for supporting said implement independently of said tractor, a tractor having oppositely disposed rear side support brackets for engagement with said standards, and a step having vertical and horizontal portions on said tractor whereby upon said vertical portion engaging said transversely extending member and said power means being operated to pivot said U-shaped frame and boom towards each other said U-shaped frame pivots about an axis through said vertical portion until said standards engage said support brackets and then pivotal action occurs about an axis through said support brackets whereby said transversely extending member is pivoted above said horizontal portion of said step and said tractor is moved forwardly relative to said implement to position said transversely extending member on said horizontal portion of said step.

4. The structure of claim 3 wherein said power means is further defined as being hydraulic cylinders extending between said U-shaped frame and said boom.

5. The structure of claim 3 wherein said step is positioned across the front end of said tractor and said transversely extending member on said U-shaped frame extends between the oppositely disposed legs of said U-shaped frame.

6. The structure of claim 3 wherein said standards and support brackets on said tractor include cooperating lock means engageable upon said implement being moved rearwardly on said tractor.

7. The structure of claim 6 wherein said lock means on said standards include rearwardly extending feet portions and said lock means on said support brackets include cross members spaced above said brackets and defining an opening for receiving said feet and thereby limit relative vertical movement of said standards.

8. The structure of claim 7 wherein a pin element is positioned to extend through said cross member on one of said brackets and engage the foot in said opening thereby limiting horizontal movement of said standard.

9. The structure of claim 8 wherein said pin is spring loaded to normally extend through said foot.

10. The structure of claim 9 wherein said pin includes an eccentrically mounted cam means connected thereto and in engagement with a stationary means whereby rotation of said cam causes said pin to be lifted against the action of said spring.

11. The structure of claim 7 wherein said feet and openings are complementarily wedged shaped.

12. The structure of claim 3 wherein stop means is positioned on said step over said horizontal portion to limit upward vertical movement of said transversely extending member.

13. The structure of claim 12 wherein said stop means includes an upstanding leg on said horizontal portion rearwardly of said vertical portion and a horizontal leg extends forwardly over said horizontal and vertical portions of said step.

* * * * *